US007076921B2

(12) United States Patent
Spradlin

(10) Patent No.: US 7,076,921 B2
(45) Date of Patent: Jul. 18, 2006

(54) GUTTER SYSTEM WITH SNAP TOGETHER PARTS

(76) Inventor: Erdman O. Spradlin, 360 Green Acres Dr., Naperville, IL (US) 60563

( * ) Notice: Subject to any disclaimer, the term of this patent is extended or adjusted under 35 U.S.C. 154(b) by 157 days.

(21) Appl. No.: 10/626,284

(22) Filed: Jul. 24, 2003

(65) Prior Publication Data

US 2005/0016076 A1 Jan. 27, 2005

(51) Int. Cl.
*E04D 13/068* (2006.01)

(52) U.S. Cl. ..... 52/11; 52/726.1; 248/48.1

(58) Field of Classification Search ..... 52/11, 52/12, 13, 14, 726.1; 248/48.1, 48.2
See application file for complete search history.

(56) References Cited

U.S. PATENT DOCUMENTS

| | | | | |
|---|---|---|---|---|
| 2,408,557 | A * | 10/1946 | Huntington | 52/466 |
| 3,296,749 | A * | 1/1967 | Cotter | 52/11 |
| 3,446,025 | A * | 5/1969 | Koch | 405/43 |
| 3,592,721 | A * | 7/1971 | Formanek | 428/121 |
| 3,864,882 | A * | 2/1975 | Lasscock | 52/11 |
| 3,913,284 | A * | 10/1975 | Hall | 52/11 |
| 4,632,342 | A * | 12/1986 | Skinner | 248/48.2 |
| 4,646,487 | A * | 3/1987 | Andersson | 52/11 |
| 4,913,785 | A | 4/1990 | Uchida et al. | |
| 5,383,310 | A * | 1/1995 | Sapia | 52/12 |
| 5,406,756 | A * | 4/1995 | Bemis et al. | 52/16 |
| 5,687,510 | A * | 11/1997 | Basista | 52/11 |
| 6,410,163 | B1 | 6/2002 | Suzuki et al. | |
| 6,560,933 | B1 * | 5/2003 | Richardson | 52/11 |
| 6,751,910 | B1 * | 6/2004 | Richardson | 52/11 |

FOREIGN PATENT DOCUMENTS

EP 1 041 167 A1 10/2000

OTHER PUBLICATIONS

Development of 590 MPa Grade Galvannealed Sheet Steels with Dual Phase Structure, Kawasaki Technical Report No. 42, May 2000, Yoichj Tobiyama, et al.
Development of New Formable Cold-Rolled Sheet Steels for Automobile Body Panels,Nippon Steel Technical Report No. 42, Jan. 1995, Atsushi Itami, et al.

(Continued)

*Primary Examiner*—Peter R. Brown
(74) *Attorney, Agent, or Firm*—Robert L. Marsh

(57) ABSTRACT

A gutter system has the portions thereof formed to permit the ends of sections thereof to be nested one within another for forming the elements of the gutter. A contour suitable for such nesting has a vertical fascia panel, a generally vertical outer panel, and a generally horizontal floor panel joining lower edges of fascia panel and the outer panel. An arcuate portion joins the lower end of the fascia panel to the floor panel. A lip is provided along the upper edge of the outer panel with the lip of a first length of gutter fitting around the lip of a second length and the arcuate portion between the fascia panel and the floor of the first length fitted around the arcuate portion joining the fascia panel and floor of the second length to provide nesting. Fold over tabs may be provided along the upper edge of the fascia panel and the lip to lock the ends of the two lengths together, or lock the end of a length of gutter to a corner unit, a down spout drop unit, or an end cap unit.

15 Claims, 5 Drawing Sheets

OTHER PUBLICATIONS

Hot Dip Galvannealing of Interstitial Free Steel Strengthened by Manganese, Galvathech 95 Conference Proceedings-115, L. Zhang, et al.

Influence of the Dew Point of the $N_2$-$H_2$Atmosphere During Recrystallization Annealing on the Steel Surface State of TiNb High Strength Steels, 41st MWSP Conf. Proc., ISS, vol. XXXVII, 1999, I. Hertveldt, et al.

* cited by examiner

GUTTER SYSTEM WITH SNAP TOGETHER PARTS

The present invention relates to gutters for draining water off the roofs of buildings, and in particular to an improved gutter system with lengths that can be easily assembled together in end-to-end relationship.

BACKGROUND OF THE INVENTION

It is common for houses to have gutters so that water flowing off the roof thereof will be directed away from doorways and windows. There is a substantial industry in gutter installation, but nonetheless many homeowners prefer to install or replace gutters on a do-it-yourself basis.

On a commercial basis, seamless gutters can be installed in which a length of gutter equal to the length of the roof portion to which it is to be attached is formed from an endless roll mounted on a truck. Such seamless gutters are not subject to leakage along the length thereof, but in reality such so-called "seamless" gutters have many seams. Specifically, a seam joins the ends of the long seamless portions to unit portions adapted to perform a function other than that performed by the long lengths. For example, unit portions exist at every corner of a building having a "seamless" gutter. A unit portion is needed to connect to each down spout and a unit portion is needed at each closed end of a length of otherwise seamless gutter. Seamless gutters cannot be installed on a do-it-yourself basis, and other gutter systems currently available through retail outlets are difficult for the inexperienced homeowner to install. Also, the seams of all existing gutter systems are subject to leakage. It would be desirable, therefore, to provide an improved gutter system in which the length of gutter need not be inordinately long so as to be difficult for a homeowner to assemble, and for which the seams between the lengths will have rigidity so as to permit assembly of the parts on the ground prior to installation, and for which the seams would be subject to a minimal amount of water leakage.

SUMMARY OF THE INVENTION

Briefly, the present invention is embodied in a gutter system consisting of a plurality of lengths that may be assemble together in end-to-end relationship using tools available to a homeowner, and further comprising a plurality of unit parts for assembly with the lengths to provide a complete gutter system. Each of the lengths of gutter has a vertical fascia panel, a generally vertical outer panel, and a generally horizontal floor panel joining lower edges of the fascia panel and the outer panel.

In accordance with the invention, an arcuate portion is provided in the junction between the fascia panel and the floor panel and a horizontal lip is provided at the upper end of the outer panel. Preferably, the curve at the juncture between the fascia panel and the floor panel has a radius of approximately 1.5 inches. The lip at the upper end of the outer panel is directed towards the upper end of the fascia panel and has a longitudinal crimp or ridge along the length thereof to improve rigidity. The structure of the curve between the fascia panel and the floor panel and the lip at the upper end of the outer panel enable the overlapping ends of adjacent lengths of gutter to snap together with the overlapping surfaces compressed together by the elastic forces of the metal of which the portions of the gutter system are made, thereby minimizing leakage at the seams.

In the preferred embodiment, conveniently sized lengths of gutter, perhaps three feet to five feet in length, are provided for easy installation by the inexperienced do-it-yourself homeowner. The adjacent lengths of gutter are assembled in end-to-end relationship by snapping or sliding a minimum of three inches of one end of a first length into the end of the adjacent length with the curved portion adjoining the fascia and the floor of a first length nested inside the curve joining the fascia and floor of a second length and the lip at the upper end of the outer panel of the first length nested within the lip of the second length. The preferred method of assembly eliminates the difficult homeowner task of cutting gutters on-site. The amount of overlap on nesting gutter sections may exceed the three-inch minimum thus allowing assembly to any length without cutting.

The parts that make up the gutter system are preferably made of a metal such as steel or aluminum, where the metal has some spring capabilities with a memory, where the spring capabilities of the metal will urge the parts to return to their original shape after being somewhat deformed as the parts are snapped together.

To lock sections of gutter in end-to-end relationship, a plurality of transverse cuts are made through the outer edge of the lip on the outer panel and on the upper end of the fascia panel, the cuts being spaced a distance of approximately one-half inch apart to form a plurality of tabs. To retain the ends of two adjacent lengths of gutter in assembled relationship, overlapping tabs on both the first and second lengths of gutter are folded over.

It is essential that the gutter lengths nest one within another for efficient production, packaging, storage, transport, and assembly. To facilitate the nesting of lengths of gutter, the fold that defines the lip and upper end of the outer panel is not commercially made. The lip is left upright as an extension of the outer panel with the location of a fold line being a perforation extending the length of the gutter. The homeowner will purchase the length of gutters nested and packaged without the fold. The installer applies hand pressure to the perforation line to form the inwardly turned lip of the outer panel.

The gutter system of the invention further includes all normally required unit portions shaped to extend around inside corners, outside corners, down spout drops, end caps, and the like. The unit portions all have the same cross-sectional shape as the length of gutter including the curve between the fascia panel and the floor panel and the lip on the upper end of the unit panels so that these parts will snap onto the end two or three inches of a length of gutter. The unit portions also have transverse cuts along the upper edge of the fascia panel and in the lip so that tabs can be folded over locking the unit portions to the adjacent lengths of gutter.

BRIEF DESCRIPTION OF THE DRAWINGS

A better understanding of the present invention will be had after a reading of the following detailed description taken in conjunction with the drawings wherein.

DETAILED DESCRIPTION OF A PREFERRED EMBODIMENT

Figure 1:
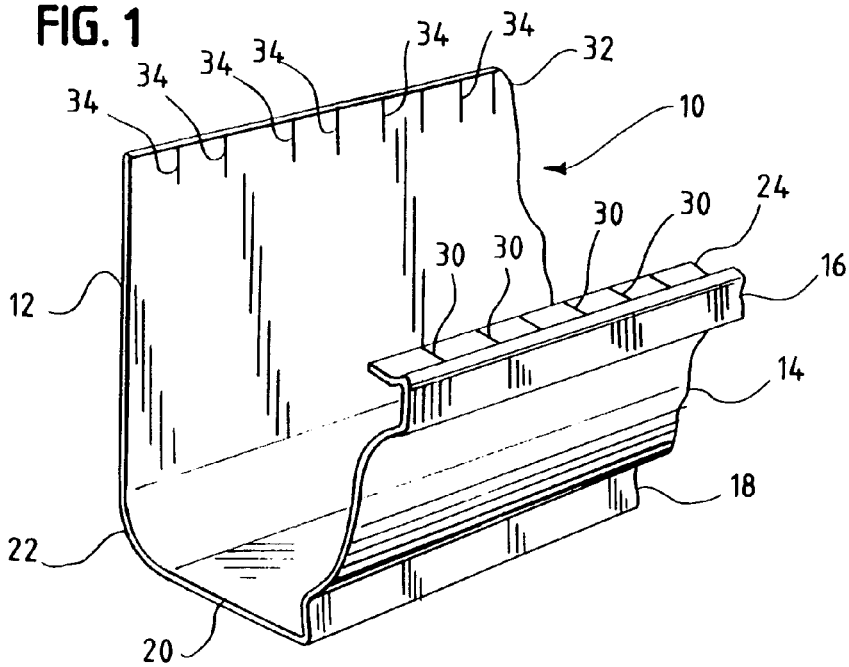
FIG. 1 is an isometric view of a length of gutter in accordance with the present invention.
Figure 2:
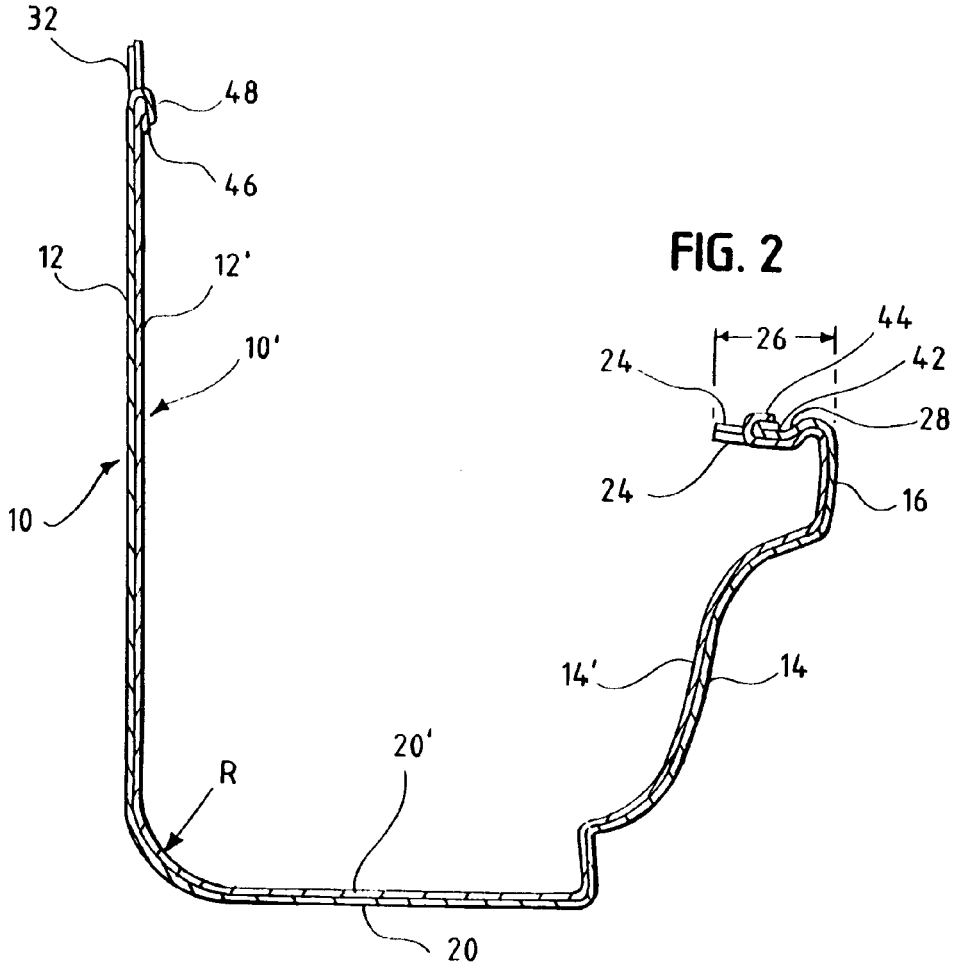
FIG. 2 is a cross-sectional view of a first and second lengths of gutter with the second length nested into the first length for retaining the two in end-to-end relationship.
Figure 3:
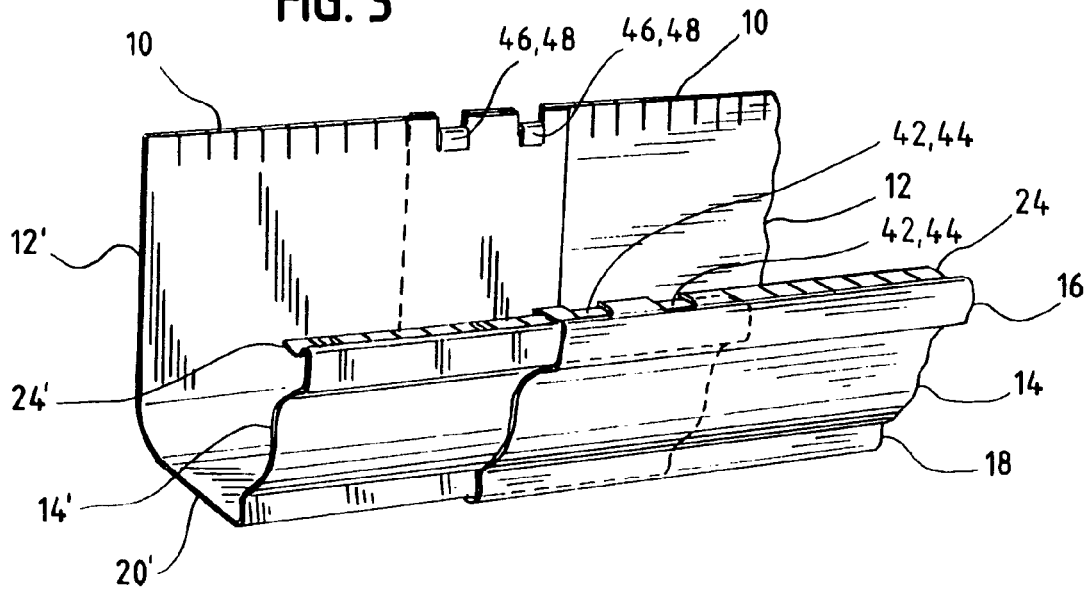
FIG. 3 is an isometric view of the lengths of gutter assembled in end-to-end relationship shown in FIG. 2.

Referring to FIGS. 1, 2 and 3, a length of gutter 10 in accordance with the present invention has a vertically oriented fascia panel 12, an outer panel 14, which extends generally vertically, but with the upper end thereof 16 spaced further from the fascia panel 12 than the lower end 18 thereof. Extending between the lower end of the fascia panel 12 and the lower end 18 is a generally planar floor panel 20. Between the lower end of the fascia panel 12 and the floor panel 20 is a curved portion 22, which preferably has a radius, R of about 1.5 inches. The intersection of the floor panel 20 with the lower end 18 of the outer panel 14 is a corner as shown. Preferably, the length of gutter 10 including the fascia panel 12, the outer panel 14, and the floor panel 20 with the curve 22 joining the floor panel 20 and fascia panel 12 are formed from a single length of metal having a degree of spring capabilities that is stamped into the desired configuration.

At the upper end 16 of the outer panel 14 is a transverse, generally horizontal lip 24 having a width 26 of approximately one inch. Extending along the length of the lip 24 is a crease 28. Extending along the outer edge of the lip 24 are a plurality of transverse cuts 30—30 spaced approximately one-half inch apart and extending into the lip 24 a distance of between one-fourth and one-half inch as shown to form a plurality of adjacent tabs. Similarly, spaced along the upper end 32 of the fascia panel 12 are a second set of transverse cuts 34—34, which are also spaced approximately one-half inch apart and extend into the fascia panel a distance of between one-fourth and one-half inch to form a second set of adjacent tabs.

In the preferred embodiment, each length of gutter 10 has a conveniently sized overall length to facilitate easy installation by the do-it-yourself homeowner, preferably between forty-eight and fifty-six inches. As best shown in FIGS. 2 and 3, to assemble a length of gutter along the length of a roof, adjacent sections 10 and 10' of gutter are positioned with at least two or three inches of a second length of gutter 10' extending into the end of a first length of gutter 10 in nesting relationship, with the curved portion 22' of the second length 10' fitted against the curve 22 of the first length 10 and the lip 24' of the second length fitted under the lip 24 of the first length 10 as shown. When assembled in this relationship, the fascia panel 12' of the second length will fit flush against the fascia panel 12 of the first length, the floor panel 20' of the second panel will fit flush against the floor panel 20 of the first length and the outer panel 14' of the second length will fit flush against the outer panel 14 of the first length.

When two lengths of gutter 10, 10' are fitted end-to-end with three inches of one end of length 10' nested into three inches of the other length 10 with the transverse cuts 30, 30' in the outer lips 24, 24' aligned adjacent to one another, and the cuts 34, 34' in the upper ends of the fascia panels 12, 12' thereof similarly aligned adjacent one another, tabs 42, 44 in the outer lips 24, 24' respectively, may be folded over upon one another as shown and one or more tabs 46, 48 on the fascia panel 12, 12' respectively, may be similarly folded upon one another to lock the lengths of gutter 10, 10' to each other. After the tabs 42, 44, 46, 48 have been folded over as shown, the overlapping lengths of gutter 10, 10' will be locked to one another and will allow only a minimum amount of water to seep between the overlapping metal surfaces thereof.

It should be appreciated that it is generally unnecessary to cut the lengths 10 of gutter to assemble a gutter system embodying the invention because the cuts 30, 34 in the fascia panel 12 and in the lip 24 respectively, extend along the entire length of the length of gutter 10.

Figure 4:
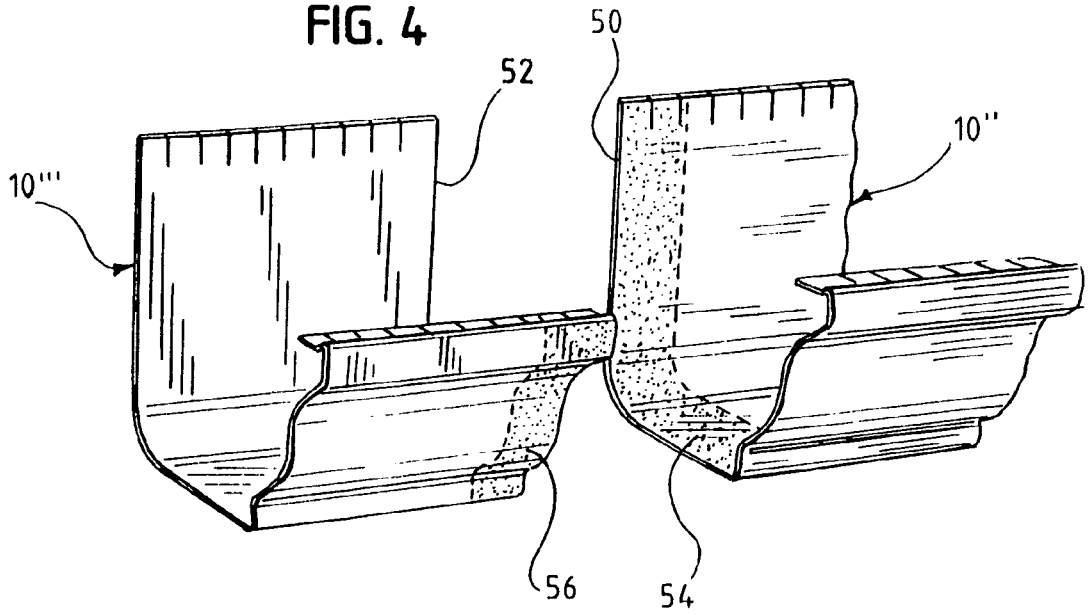
FIG. 4 is an isometric view of the ends of two lengths of gutter in accordance with the invention having the ends thereof coated with a sealant.

To further prevent leakage between overlapping portions of the lengths of gutter, a sealant may be applied to the ends of gutter. Referring to FIG. 4, in an alternate embodiment, a length of gutter may be manufactured with a sealant 54 applied to a strip of about two inches wide on the inner end 50 of a length of gutter 10" and a similar strip of sealant 56 applied to the outer surface adjacent the opposite end 52 thereof. Adjacent lengths of gutter 10" and 10'" may therefore be assembled with the sealant strip 54 on the inner surface of one length 10" against the sealant strip 56 on the outer surface of an adjacent length 10'". Because of the tightness with which the parts fit together, only a small amount of sealant is needed on the strips 54, 56.

Referring to FIGS. 5–8, the invention further includes various unit portions that can be joined to the lengths 10 to form a complete gutter system. Specifically, the invention includes an inside corner unit 60 shown in FIG. 5, an outside corner unit shown in FIG. 6, a down spout drop unit 80 shown in FIG. 7, and an end cap unit 90 shown in FIG. 8.

Figure 5:
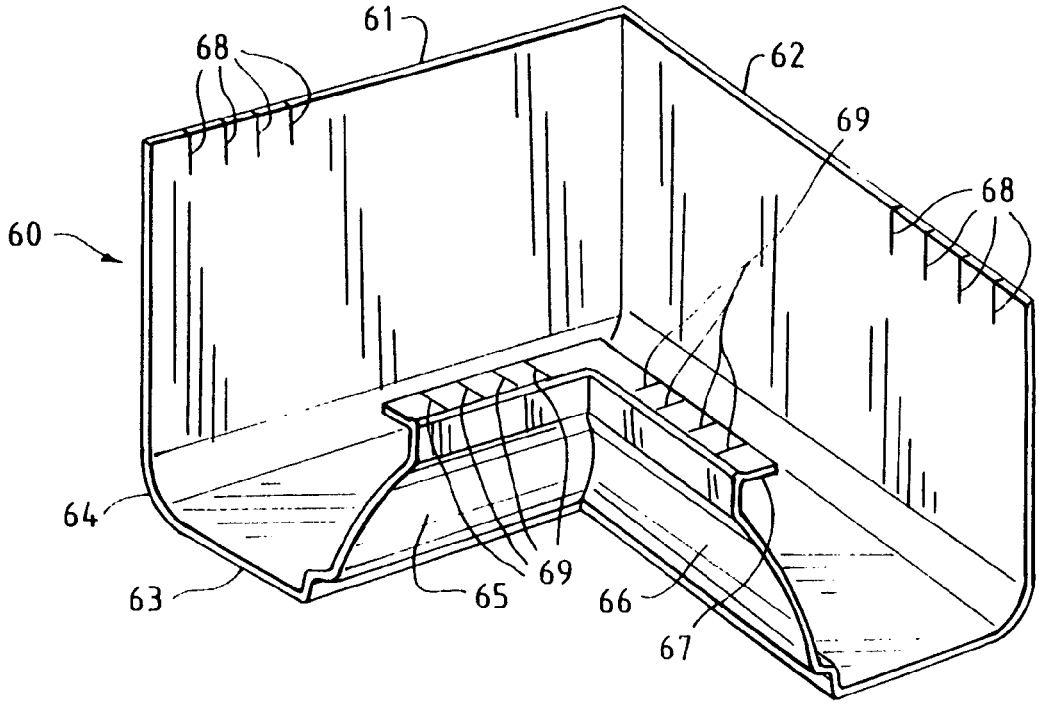
FIG. 5 is an isometric view of an inside corner unit portion embodying the invention.

Referring to FIG. 5, the inside corner unit 60 has an inside corner formed by adjacent fascia panels 61, 62, a floor 63, and a curved portion 64 between the fascia panels 61, 62 and the floor 63 as described with respect to the length of gutter 10. The inside corner unit 60 also has outer panels 65, 66 joined at right angles and a lip 67 that extends along the upper edge of the joined outer panels with the parts sized to snap into the ends of the lengths of gutter 10 as has been described above. At the two ends, the corner unit 60 has a plurality of parallel transverse cuts 68, 69 in the upper ends of the fascia panel 61, 62 and on the lip 67 respectively forming a plurality of tabs for locking the corner unit 60 to an adjoining length of gutter 10 as has been described above.

Figure 6:
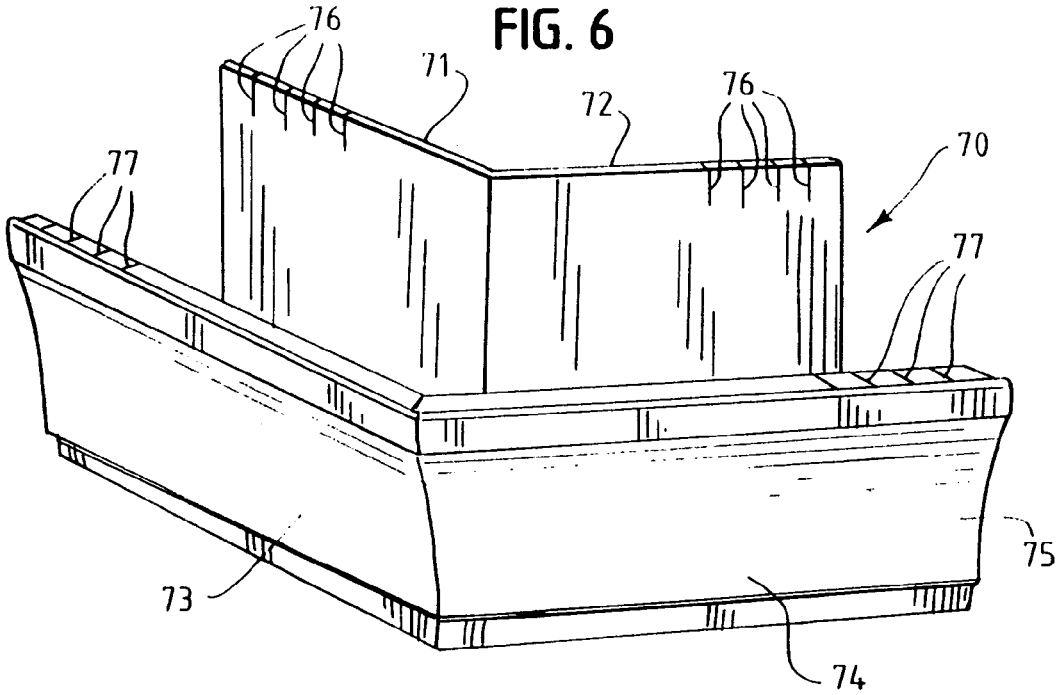
FIG. 6 is an isometric view of an outside corner unit portion embodying the invention.

Referring to FIG. 6, the outside corner unit 70 is configured much like the inside corner unit 60 but with the various panels—fascia panels 71, 72, floor panel, not shown, and outer panels 73, 74 are configured for an outside corner. The outside corner unit 70 also has a curved portion, not shown, between each of the fascia panels 71, 72 and the floor, not shown, and a lip 75 at the upper ends of the outer panels 73, 74. Similarly, the fascia panels 71, 72 and the lip 75 have transverse cuts 76, 77 respectively for forming tabs to lock the unit 70 to adjacent gutter members.

Figure 7:
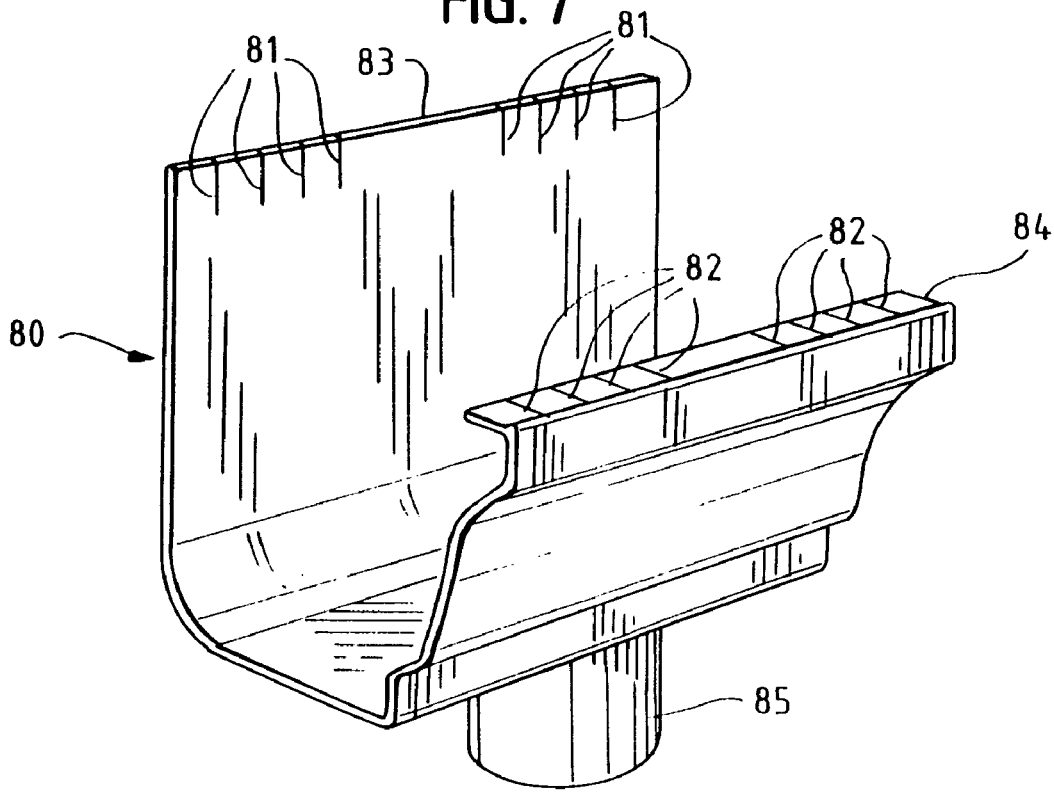
FIG. 7 is an isometric view of a down spout drop unit portion embodying the invention.

Referring to FIG. 7, the down spout drop unit 80 has the same cross-sectional configuration as all the other parts for snap together assembly. The unit 80 also has transverse cuts 81, 82 in the fascia panel 83 and in the lip 84 respectively, and has a stub of gutter down spout 85 for receiving a length of down spout.

Figure 8:
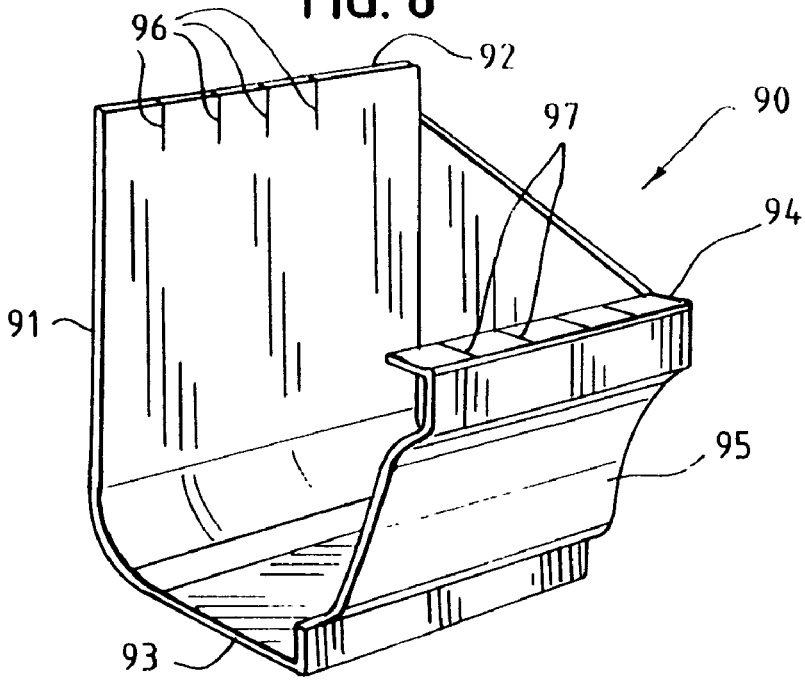
FIG. 8 is an isometric view of an end cap embodying the invention.

Referring to FIG. 8, the end cap unit 90 has the same cross-sectional configuration described with respect to the other parts including the curve 91 between the fascia 92 and the floor panel 93, and a lip 94 at the upper end of the outer panel 95. Transverse cuts 96, 97 in the upper end of the fascia panel 92 and in the lip 94 form parallel tabs for locking the end cap 90 to an adjacent length of gutter 10.

Figure 9:
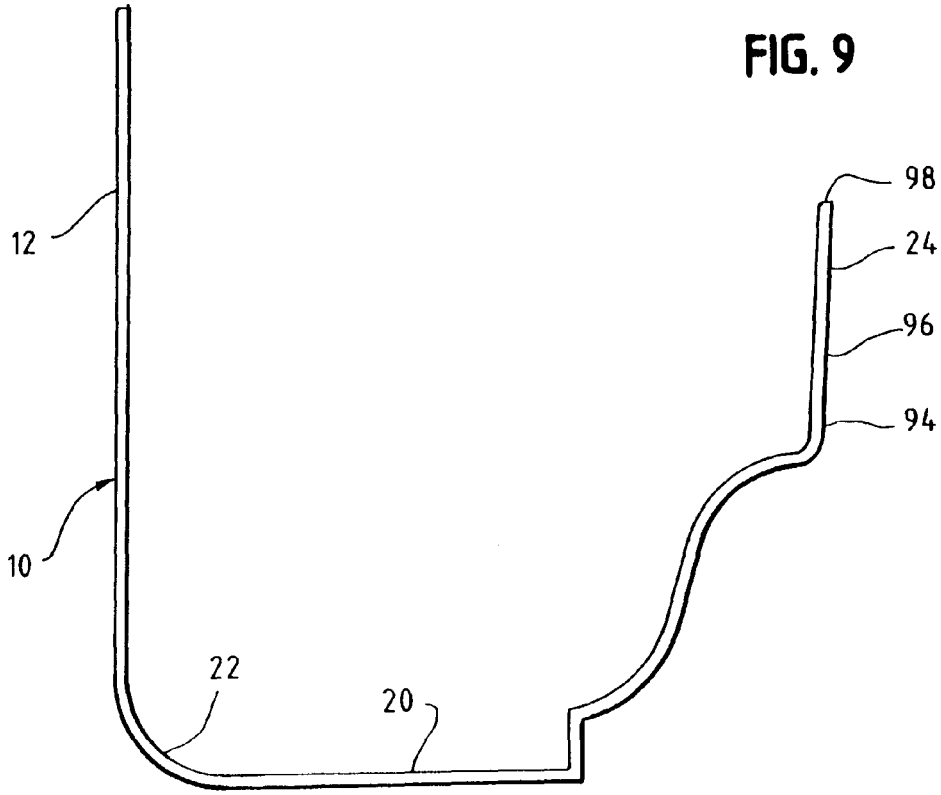
FIG. 9 is and end view of a length of gutter in accordance with the invention without the fold between the outer panel and the lip.
Figure 10:
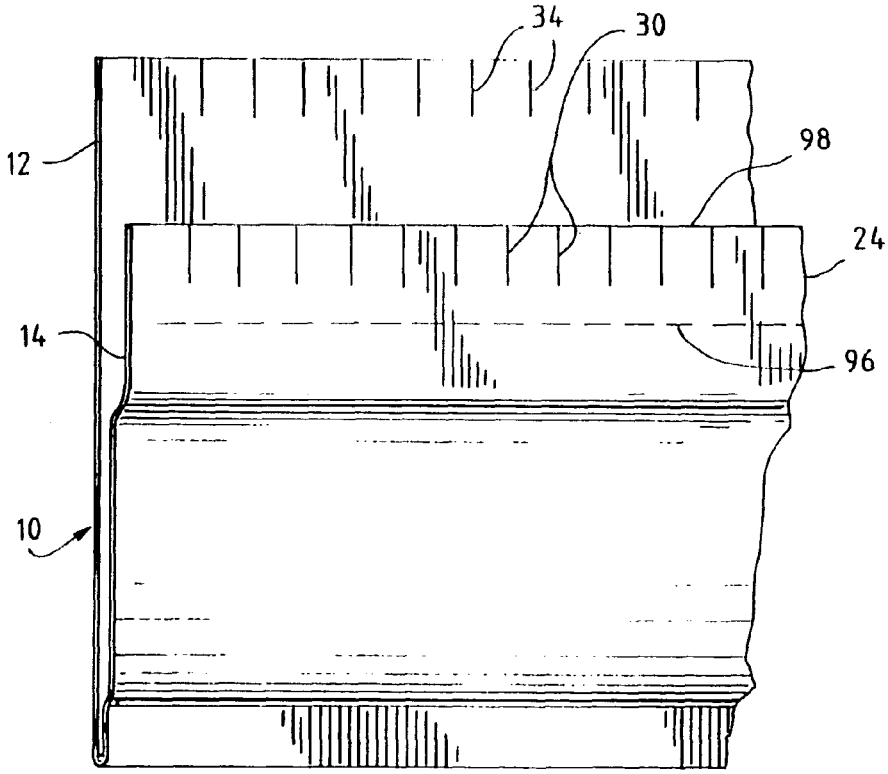
FIG. 10 is a front elevational of the length of gutter shown in FIG. 9.

Referring to FIGS. 1, 9 and 10, a plurality of six, ten, twenty or more of gutter lengths 10, 10', 10" . . . having the cross sectional shape of the length shown in FIG. 1 cannot be nested together with the surfaces of each gutter length abutting a corresponding surface of the adjacent gutter length because the thickness of the metal of which the lengths 10, 10', 10", . . . are made will progressively reduce the space available between the inner surface of the lip 24 and the curved portion 22 of the outermost length 10. In order to permit the nesting of ten, twenty or more gutter lengths 10 the gutter lengths 10 must be manufactured and sold prior to the making of the fold 27 between the outer panel 14 and the lip 24. As best shown in FIG. 9, prior to making the fold 27 the lip 24 consists of a vertical extension of the outer panel 14.

Referring specifically to FIG. 10, although the omission of the fold 27 permits the nesting of a plurality of lengths 10, 10', 10" . . . , the invention requires that the fold 27 be made after the desired number of lengths 10 have been purchased and transported to the construction site. To facilitate a homeowner who then desires to create the fold 27 so that the lip 24 will be oriented perpendicular to the outer panel 14, (as shown in FIG. 1) a perforation 96 is provided along the length of the outer panel 14 parallel to the upper edge 98 of the extended outer panel 14. The perforation 96 defines the location of the fold 27. To make the fold 27 a homeowner will apply hand pressure to bend the metal of which the length 10 is made, the bend being made along the perforations 96 to thereby form the fold 27.

The present invention may further be used with a panel with apertures therein to allow water to flow into the gutter system while washing leaves and other trash off the upper surface of the panel. Such a panel is described in my previously issued U.S. Pat. No. 6,202,357 B1 issued Mar. 20, 2001.

Because of the rigidity with which the parts can be held together, a gutter assembly in accordance with the invention can be assembled on the ground using simple tools, such as a pair of pliers. No additional parts or connectors are needed to join the elements of the invention, and once assembled, the seams of the system should be substantially leak-free.

While the present invention has been depicted with respect to a single embodiment, it will be appreciated that many modifications and variations may be made without departing from the true spirit and scope of the invention. It is therefore the intent of the independent claims to cover all such variations and modifications which fall within the true spirit and scope of the invention.

What is claimed is:

1. A length of gutter having a vertical fascia panel having an upper end, a generally vertical outer panel, and a generally horizontal floor panel joining the lower edges of said fascia panel and said outer panel, said gutter having the improvement comprising, a curved portion between said floor panel and said fascia panel, an outer lip extending from said outer panel wherein an end of a first length of said gutter will receive an end of a second length of gutter identical to said first length of gutter with said end of said second length nested into said end of said first length of gutter and said second length of gutter is longitudinally adjustable with respect to said first length of gutter wherein a combined length of said first length and said second length is determined without cutting one of said first length and said second length, and a plurality of spaced vertical cuts in said upper end of said fascia panel forming a plurality of adjacent tabs wherein a first of said plurality of tabs on said length of gutter is positionable to overlap a second tab on said second length of gutter and said first and second tabs are foldable together to lock said lengths of gutter together.

2. The length of gutter of claim 1 wherein said improvement further comprises a plurality of spaced cuts in said outer lip, said spaced cuts forming a second plurality of adjacent tabs wherein one of said second plurality of tabs is foldable together with an overlapping fourth tab on said second length of gutter to further lock said lengths of gutter together.

3. The length of gutter of claim 2 wherein said plurality of spaced cuts in said outer lip and said plurality of spaced vertical cuts in said upper end extend along an entire length of said length of gutter.

4. The length of gutter of claim 1 and further comprising a sealant applied to a portion of said fascia panel, said outer panel and said floor for sealing against surfaces of said second length of gutter.

5. The length of gutter of claim 1 and further comprising a plurality of spaced tabs on said outer lip wherein one of said tabs of said length of gutter can be folded over a portion of said second length of gutter to lock said lengths together at said combined length.

6. A length of gutter having a vertical fascia panel, a generally vertical outer panel, and a generally horizontal floor panel joining lower edges of said fascia panel and said outer panel, said gutter further comprising, a lip extending from an upper edge of said outer panel, a plurality of transverse cuts in said lip to form a plurality of adjacent tabs, a plurality of transverse cuts in an upper edge of said fascia panel to form a second plurality of tabs, and said length of gutter having an end configured for nesting into an end of a second length of gutter wherein said tabs on said lip and said tabs on said fascia panel of said length of gutter overlap tabs on a lip and on a fascia panel of said second length of gutter and said overlapping tabs are foldable together to lock said nested ends to one another.

7. The length of gutter of claim 6 and further comprising a curved portion between said fascia panel and said generally horizontal floor.

8. The length of gutter of claim 6 and further comprising a sealant applied to a portion of said fascia panel, said outer panel and said floor for sealing against surfaces of said second length of gutter.

9. A gutter system comprising a plurality of gutter lengths, said gutter lengths each having two ends, a plurality of gutter unit portions, said gutter unit portions each having at least one end, said ends of said gutter length and said ends of said gutter unit portion shaped for nesting in an adjacent end of another of said gutter lengths and said gutter unit portions, and said ends of said gutter lengths and said ends of said gutter unit portions having tabs wherein overlapping ones of said tabs may be folded over to lock said nested ends to one another.

10. A gutter system of claim 9 wherein said gutter unit portions include down spout drops, corners, and end caps.

11. A gutter unit portion for connecting to an end of a length of gutter, said length of gutter having an outer up and a fascia panel upper end with a plurality of spaced cuts in said outer lip and said fascia panel upper end to form pluralities of adjacent tabs, said gutter unit portion comprising an end adapted to nest with respect to said end of said length of gutter, said end of said gutter unit having a fascia panel upper end portion, a tab on said fascia panel upper end that overlaps one of said tabs on said fascia panel upper end of said length of gutter wherein said fascia panel upper end tabs are foldable together to retain said gutter unit portion to said length of gutter.

12. The gutter unit portion of claim 11 and further comprising a forward panel, a lip on said forward panel, a tab on said lip that overlaps one of said tabs on said outer lip of said length of gutter wherein said lip tabs are foldable together to further retain gutter unit portion to said length of gutter.

13. A length of gutter having a vertical fascia panel, a generally vertical outer panel, and a generally horizontal floor panel joining the lower edges of said fascia panel and said outer panel, said gutter having the improvement comprising, a curved portion between said floor panel and said fascia panel, and an outer lip extending generally vertically from said outer panel, and a fold line between said outer panel and said outer lip wherein said outer lip is foldable along said crease to extend generally horizontally and wherein a plurality of said lengths of gutter will nest together for storage while said outer lip extends vertically.

14. The length of gutter of claim 13 wherein said fold line is a perforation.

15. A length of gutter having a vertical fascia panel, a generally vertical outer panel, and a generally horizontal floor panel joining the lower edges of said fascia panel and said outer panel, said gutter having the improvement comprising, a curved portion between said floor panel and said fascia panel, an outer lip extending from said outer panel wherein an end of a first length of said gutter will receive an end of a second length of gutter identical to said first length of gutter with said end of said second length nested into said end of said first length of gutter and said second length of gutter is longitudinally adjustable with respect to said first length of gutter wherein a combined length of said first length and said second length is determined without cutting one of said first length and said second length, and a plurality of spaced cuts in said outer lip, said spaced cuts forming a plurality of adjacent tabs wherein a first of said plurality of tabs on said length of gutter is positionable to overlap a second tab on said second length of gutter and said first and second tabs are foldable together to lock said lengths of gutter together.

* * * * *